US009837797B2

(12) United States Patent
Inoue

(10) Patent No.: US 9,837,797 B2
(45) Date of Patent: Dec. 5, 2017

(54) IGNITION PLUG

(71) Applicant: NGK SPARK PLUG CO., LTD., Nagoya-shi, Aichi (JP)

(72) Inventor: Masahiro Inoue, Gifu (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/456,072

(22) Filed: Mar. 10, 2017

(65) Prior Publication Data

US 2017/0271852 A1 Sep. 21, 2017

(30) Foreign Application Priority Data

Mar. 16, 2016 (JP) ..... 2016-052004
Oct. 14, 2016 (JP) ..... 2016-202561

(51) Int. Cl.
*H01T 13/32* (2006.01)
*H01T 13/39* (2006.01)
*H01T 13/34* (2006.01)
*H01T 13/20* (2006.01)

(52) U.S. Cl.
CPC ..... *H01T 13/32* (2013.01); *H01T 13/20* (2013.01); *H01T 13/34* (2013.01); *H01T 13/39* (2013.01)

(58) Field of Classification Search
CPC ..... H01T 13/32; H01T 13/39; H01T 13/20; H01T 13/34; H01T 13/36
See application file for complete search history.

(56) References Cited

U.S. PATENT DOCUMENTS 6,215,235 B1 * 4/2001 Osamura ..... H01T 13/39 313/141
6,819,031 B2 * 11/2004 Hori ..... H01T 13/39 313/118
6,853,116 B2 * 2/2005 Hori ..... H01T 13/39 313/118
6,997,767 B2 * 2/2006 Taniguchi ..... H01T 13/39 219/121.64
8,841,827 B2 * 9/2014 Sakayanagi ..... H01T 13/32 313/118

(Continued)

FOREIGN PATENT DOCUMENTS

JP 2015-125879 A 7/2015

OTHER PUBLICATIONS

European Patent Office, Extended European Search Report issued in corresponding Application No. EP17161342, dated Aug. 22, 2017.

*Primary Examiner* — Joseph L Williams
*Assistant Examiner* — Jose M Diaz
(74) *Attorney, Agent, or Firm* — Stites & Harbison, PLLC; Jeffrey A. Haeberlin

(57) ABSTRACT

An ignition plug includes an insulator that includes a through hole; a center electrode; a metal shell that holds the insulator; a bar-shaped ground electrode body; an electrode tip that is disposed along a side surface of the ground electrode body opposing a discharge surface of the center electrode; and a welding portion that is disposed between the ground electrode tip and the ground electrode body. Over ¼ of a range from a first end to a second end of the ground electrode tip, a length L1 of the ground electrode tip and a length L2 of the welding portion in the direction satisfy (L2/L1)≥0.25.

5 Claims, 5 Drawing Sheets

(56) References Cited

U.S. PATENT DOCUMENTS

| | | | | |
|---|---|---|---|---|
| 8,922,104 | B1 * | 12/2014 | Inoue | H01T 13/20 313/141 |
| 8,994,257 | B2 * | 3/2015 | Ishiguro | H01T 13/39 313/144 |
| 9,236,715 | B2 * | 1/2016 | Sakakura | H01T 13/32 |
| 2004/0189169 | A1 | 9/2004 | Taniguchi et al. | |
| 2006/0220511 | A1 * | 10/2006 | Hanashi | H01T 13/20 313/141 |
| 2007/0290593 | A1 * | 12/2007 | Kowalski | H01T 13/32 313/141 |
| 2010/0109502 | A1 | 5/2010 | Nakayama et al. | |
| 2010/0289398 | A1 | 11/2010 | Kato et al. | |
| 2011/0148276 | A1 | 6/2011 | Sakayanagi et al. | |
| 2012/0019120 | A1 * | 1/2012 | Nakayama | H01T 13/39 313/141 |
| 2013/0069516 | A1 | 3/2013 | Sumoyama et al. | |
| 2013/0200773 | A1 * | 8/2013 | Sakayanagi | H01T 13/32 313/141 |
| 2017/0033540 | A1 * | 2/2017 | Suzuki | H01T 13/32 |

* cited by examiner

IGNITION PLUG

CROSS REFERENCE TO RELATED APPLICATIONS

The present application claims priority to Japanese Patent Application No. 2016-052004 filed on Mar. 16, 2016 and Japanese Patent Application No. 2016-202561 filed on Oct. 14, 2016, the disclosures of which are herein incorporated by reference in their entirety.

BACKGROUND OF THE INVENTION

Field of the Invention

The present specification relates to an ignition plug for igniting fuel gas in, for example, an internal combustion engine.

Description of the Related Art

Regarding ignition plugs, a technology of joining an electrode tip to an electrode body in order to increase the durability of the electrode is known (see, for example, PTL 1). The electrode tip is made of a material that is more durable with respect to spark discharge and oxidation than the electrode body. Examples of the material include a noble metal (such as platinum, iridium, ruthenium, and rhodium) and an alloy containing a noble metal as a main component. Since the electrode body and the electrode tip are joined to each other by using various methods, such as laser welding and resistance welding, a welding portion is formed between the electrode body and the electrode tip.

When an ignition plug is used in an internal combustion engine, thermal stress occurs in the welding portion due to combustion heat. Therefore, cracks tend to occur at a boundary between the electrode tip and the welding portion and at a boundary between the electrode body and the welding portion. When such cracks occur at these boundaries, the electrode tip may be peeled off from the electrode body.

CITATION LIST

Patent Literature

Patent Document 1 is Japanese Patent Application Laid-Open (kokai) No. 2015-125879.

BRIEF SUMMARY OF THE INVENTION

Here, since ignition plugs tend to be used under higher temperature environments due to, for example, higher output of internal combustion engines in recent years, the aforementioned thermal stress tends to be large. Therefore, for ignition plugs, a technology of increasing resistance with respect to peeling of the electrode tip from the electrode body (hereunder referred to as "anti-peeling performance") is required.

The present specification discloses a technology that is capable of increasing anti-peeling performance of an electrode tip.

The technology that is disclosed in the present specification can be realized in, for example, the following application examples.

First Application Example

An ignition plug includes an insulator that includes a through hole; a center electrode that includes a first discharge surface and that is held at a front end side of the through hole; a metal shell that is disposed around the insulator in a radial direction and that holds the insulator; a bar-shaped ground electrode body that includes a joining end surface and a free end surface, the joining end surface being joined to a front end of the metal shell, the free end surface being positioned opposite to the joining end surface; a ground electrode tip that, in a vicinity of the free end surface of the ground electrode body, is disposed along a side surface of the ground electrode body opposing the first discharge surface, and that includes a second discharge surface opposing the first discharge surface; and a welding portion that is disposed between the ground electrode tip and the ground electrode body, and that includes a component of the ground electrode tip and a component of the ground electrode body. In a section which extends through a center of gravity of the second discharge surface, which is perpendicular to the second discharge surface, and which is parallel to an axial line of the ground electrode body:

when a direction from the center of gravity of the second discharge surface to the free end surface along the second discharge surface is a first direction, and a direction opposite to the first direction is a second direction;

when, of an end, located in the first direction, of a boundary between the welding portion and the ground electrode tip and an end, located in the first direction, of a boundary between the welding portion and the ground electrode body, the end that is positioned towards a side in the second direction is a first end; and when an end of the ground electrode tip located in the second direction is a second end;

an end of the welding portion located in the first direction is exposed at the free end surface;

the welding portion extends along the axial line of the ground electrode body; and in an entire ¼ range, provided at a side of the second end, of a range in the first direction from the first end to the second end, (i.e., over an entire sub-range of a range, the range extending from the first end to the second end, the sub-range being ¼ of the range nearest the second end) a length L1 of the ground electrode tip in a direction perpendicular to the first direction and a length L2 of the welding portion in the direction perpendicular to the first direction satisfy (L2/L1)≥0.25.

According to the above-described structure, in the ¼ range, provided at the second end side and where thermal stress tends to occur, of the range in the first direction from the first end to the second end, the length L2 of the welding portion in the direction perpendicular to the first direction can be made sufficiently large with respect to the length L1 of the ground electrode tip in the direction perpendicular to the first direction. As a result, thermal stress can be properly reduced by the welding portion, so that it is possible to increase anti-peeling performance of the ground electrode tip.

Second Application Example

In the ignition plug according to the first application example, in the section, further, in the range in the first direction from the first end to the second end in an entirety thereof, the length L1 of the ground electrode tip in the direction perpendicular to the first direction and the length L2 of the welding portion in the direction perpendicular to the first direction satisfy (L2/L1)≥0.25.

According to the above-described structure, in the range in the first direction from the first end to the second end in its entirety, the length L2 of the welding portion in the direction perpendicular to the first direction can be made sufficiently large with respect to the length L1 of the ground electrode tip in the direction perpendicular to the first direction. As a result, thermal stress can be further properly reduced by the welding portion, so that it is possible to further increase anti-peeling performance of the ground electrode tip.

Third Application Example

In the ignition plug according to the first application example or the second application example, in the section, further, a length L3 from the second end to an end of the welding portion located in the second direction is greater than or equal to 0.1 mm.

According to the above-described structure, since the welding portion can more effectively reduce thermal stress in the vicinity of the end of the ground electrode tip located in the second direction, it is possible to further increase anti-peeling performance of the ground electrode tip.

Fourth Application Example

In the ignition plug according to any one of the first application example to the third application example, in the section, further, in the entire ¼ range, provided at the side of the second end, of the range in the first direction from the first end to the second end, the length L1 of the ground electrode tip in the direction perpendicular to the first direction and the length L2 of the welding portion in the direction perpendicular to the first direction satisfy (L2/L1) 0.5.

According to the above-described structure, it is possible to prevent the occurrence of cracks in the ground electrode tip caused by the length L1 of the ground electrode tip in the direction perpendicular to the first direction being excessively small with respect to the length L2 of the welding portion in the direction perpendicular to the first direction in the ¼ range, provided at the second end side.

Fifth Application Example

In the ignition plug according to any one of the first application example to the fourth application example, an end of the ground electrode tip located in the first direction is positioned towards the side in the second direction than the free end surface of the ground electrode body is (i.e., the free end surface extends in the first direction more than the first end of the ground electrode tip).

According to the above-described structure, since the joining area can be made sufficiently large with respect to the size of the ground electrode tip, it is possible to further increase anti-peeling performance of the ground electrode tip.

The technology that is disclosed in the present specification can be realized in various forms. For example, the technology can be realized in an ignition plug, an ignition system using the ignition plug, an internal combustion engine in which the ignition plug is installed, and an internal combustion engine in which the ignition system using the ignition plug is installed.

BRIEF DESCRIPTION OF THE DRAWINGS

Illustrative aspects of the invention will be described in detail with reference to the following figures wherein.

DESCRIPTION OF THE PREFERRED EMBODIMENTS

A. First Embodiment: Structure of Ignition Plug

Figure 1:
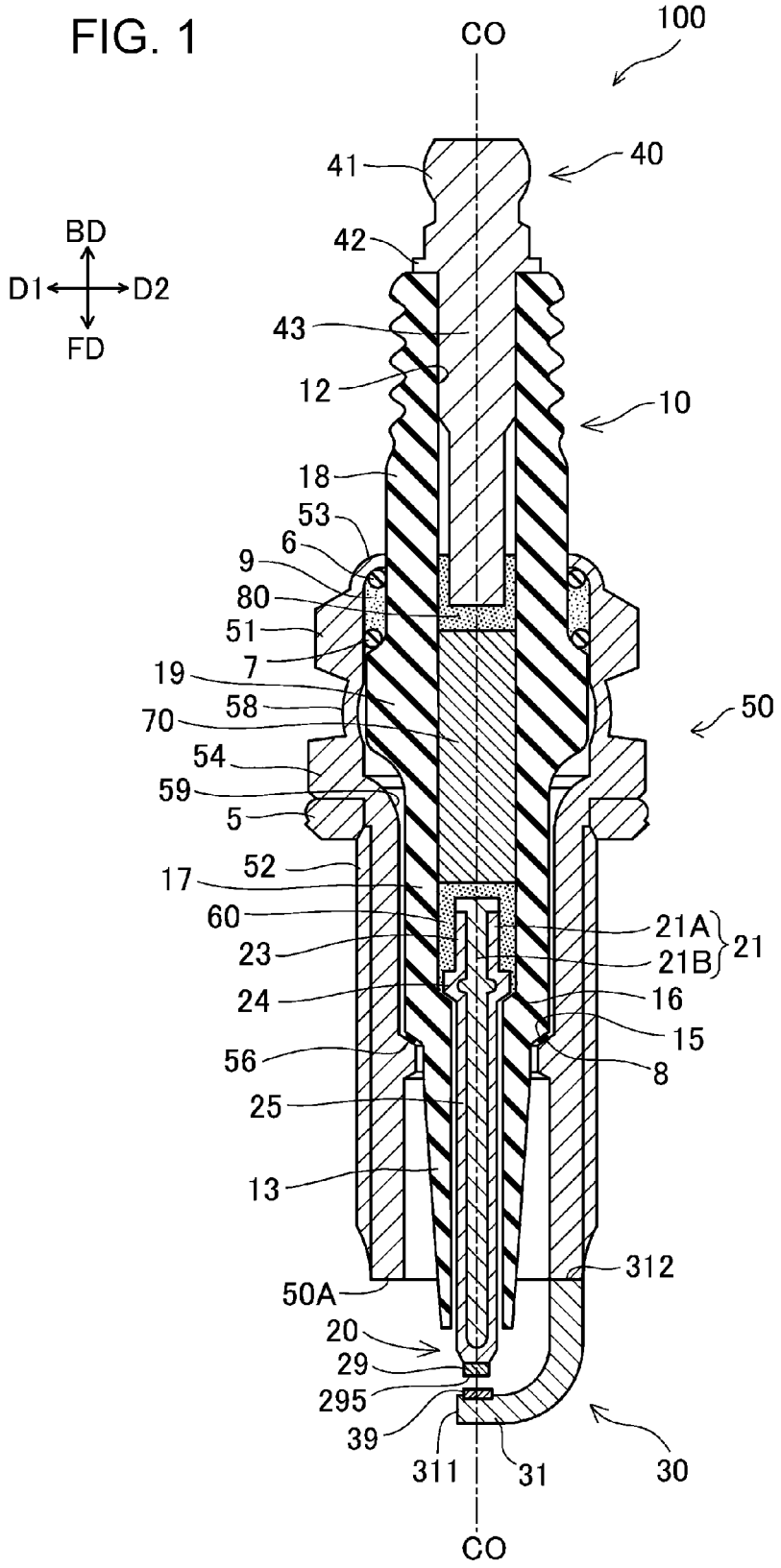
FIG. 1 is a sectional view of an ignition plug according to an embodiment.

FIG. 1 is a sectional view of an ignition plug 100 according to an embodiment. The alternate long and short dash line in FIG. 1 indicates an axial line CO of the ignition plug 100 (also called the "axial line CO"). Directions that are parallel to the axial line CO (up-down directions in FIG. 1) are also called axial directions. Radial directions of a circle around the axial line CO are also simply called "radial directions", and circumferential directions of the circle around the axial line CO are also simply called "circumferential directions". The downward direction in FIG. 1 is also called a "front end direction FD", and the upward direction in FIG. 2 is also called a "rear end direction BD". A lower side in FIG. 1 is called a "front end side" of the ignition plug 100, and an upper side in FIG. 1 is called a "rear end side" of the ignition plug 100. The ignition plug 100 includes an insulator 10, a center electrode 20, a ground electrode 30, a terminal metal shell 40, and a metal shell 50.

The insulator 10 is formed by sintering, for example, alumina. The insulator 10 is a substantially cylindrical member having a through hole 12 (axial hole) extending along the axial directions and through the insulator 10. The insulator 10 includes a flange 19, a rear-end-side body 18, a front-end-side body 17, a stepped portion 15, and an insulator nose length portion 13. The rear-end-side body 18 is positioned towards the rear end side than the flange 19 is, and has an outside diameter that is smaller than the outside diameter of the flange 19. The front-end-side body 17 is positioned towards the front end side than the flange 19 is, and has an outside diameter that is smaller than the outside diameter of the flange 19. The insulator nose length portion 13 is positioned towards the front end side than the front-end-side body 17 is, and has an outside diameter that is smaller than the outside diameter of the front-end-side body 17. When the ignition plug 100 is installed in an internal combustion engine (not shown), the insulator nose length portion 13 is exposed to a combustion chamber thereof. The stepped portion 15 is disposed between the insulator nose length portion 13 and the front-end-side body 17.

The metal shell 50 is a cylindrical metal shell that is made of a conductive metal material (such as low-carbon steel) and that is provided for securing the ignition plug 100 to an engine head (not shown) of the internal combustion engine. The metal shell 50 has an insertion hole 59 extending therethrough along the axial line CO. The metal shell 50 is disposed around the insulator 10 in a radial direction (that is, is disposed along an outer periphery of the insulator 10). In other words, the insulator 10 is inserted and held in the insertion hole 59 in the metal shell 50. The front end of the insulator 10 protrudes towards the front end side from the front end of the metal shell 50. The rear end of the insulator 10 protrudes towards the rear end side from the rear end of the metal shell 50.

The metal shell 50 includes a tool engaging portion 51, a mounting threaded portion 52, and a flanged seating portion 54. The tool engaging portion 51 has a hexagonal prism shape, and allows an ignition plug wrench to engage therewith. The mounting threaded portion 52 is provided for being installed in the internal combustion engine. The seating portion 54 is disposed between the tool engaging portion 51 and the mounting threaded portion 52. The nominal diameter of the mounting threaded portion 52 is, for example, M8 (8 mm), M10, M12, M14, or M18.

An annular gasket 5, which is formed by bending a metal plate, is fitted and inserted in a space between the mounting threaded portion 52 and the seating portion 54 of the metal shell 50. When the ignition plug 100 is installed in the internal combustion engine, the gasket 5 seals a gap between the ignition plug 100 and the internal combustion engine (engine head).

The metal shell 50 further includes a thin crimping portion 53 that is disposed on the rear end side of the tool engaging portion 51, and a thin compression deformation portion 58 that is disposed between the seating portion 54 and the tool engaging portion 51. Ring members 6 and 7 are disposed in an annular region that is formed between an inner peripheral surface, extending from the tool engaging portion 51 to the crimping portion 53, of the metal shell 50 and an outer peripheral surface of the rear-end-side body 18 of the insulator 10. Talc 9 in the form of powder fills a space between the two ring members 6 and 7 in this region. The rear end of the crimping portion 53 is bent inward in a radial direction, and is fixed to the outer peripheral surface of the insulator 10. The compression deformation portion 58 of the metal shell 50 is, during manufacturing, compressed and deformed by pressing the crimping portion 53, which is fixed to the outer peripheral surface of the insulator 10, towards the front end side. By compressing and deforming the compression deformation portion 58, the insulator 10 is pressed towards the front end side in the metal shell 50 via the ring members 6 and 7 and the talc 9. By a stepped portion 56 (metal-shell stepped portion), which is formed at an inner periphery of the mounting threaded portion 52 of the metal shell 50, the stepped portion 15 (insulator stepped portion) of the insulator 10 is pressed. As a result, gas in the combustion chamber of the internal combustion engine is prevented from leaking to the outside from a gap between the metal shell 50 and the insulator 10 by a plate packing 8.

The center electrode 20 includes a center electrode body 21 that is bar-shaped and that extends in the axial directions, and a center electrode tip 29. The center electrode body 21 is held in a front-end-side portion in the through hole 12 in the insulator 10. The center electrode body 21 includes an electrode base material 21A and a core 21B that is buried in the electrode base material 21A. The base material 21A is composed of, for example, nickel or an alloy whose main component is nickel (such as NCF 600 and NCF 601). The core 21B is made of copper or an alloy whose main component is copper, the copper and the copper alloy having a thermal conductivity that is higher than that of the alloy of which the electrode base material 21A is composed. In the embodiment, the core 21B is made of copper.

The center electrode body 21 includes a flange 24 (also called the "flanged portion") that is disposed in a predetermined location in the axial directions, a head 23 (electrode head) that is disposed towards the rear end side than the flange 24 is, and a leg 25 (electrode leg) that is disposed towards the front end side than the flange 24 is. The flange 24 is supported by the stepped portion 16 of the insulator 10. A front end portion of the leg 25, that is, the front end of the center electrode body 21 protrudes towards the front end side from the front end of the insulator 10.

The center electrode tip 29 is a substantially columnar member, and is joined to the front end of the center electrode body 21 (the front end of the leg 25) by, for example, laser welding. The front end surface of the center electrode tip 29 is a first discharge surface 295 that forms a spark gap between the front end surface of the center electrode tip 29 and a ground electrode tip 39 (described later). The center electrode tip 29 is made of, for example, a material whose main component is a noble metal having a high melting point. Examples of the material of the center electrode tip 29 are iridium (Ir) or an alloy whose main component is Ir.

The ground electrode 30 includes a ground electrode body 31 that is joined to the front end of the metal shell 50, and the quadrangular-prism-shaped ground electrode tip 39. The ground electrode body 31 is a bar-shaped member that is curved and that has a square shape in cross section. The ground electrode body 31 includes a free end surface 311 and a joining end surface 312 as two end surfaces. The joining end surface 312 is joined to a front end surface 50A of the metal shell 50 by, for example, resistance welding. This causes the metal shell 50 and the ground electrode body 31 to be electrically coupled to each other.

The ground electrode body 31 is made of, for example, nickel or an alloy whose main component is nickel (such as NCF 600 and NCF 601). The ground electrode body 31 has a two-layer structure including a base material and a core. The base material is composed of a metal having high anti-corrosiveness (such as a nickel alloy). The core is made of a metal having high thermal conductivity (such as copper), and is buried in the base material.

The terminal metal shell 40 is a bar-shaped member that extends in the axial directions. The terminal metal shell 40 is made of a conductive metal material (such as low-carbon steel). A metal layer (such as an Ni layer), which is provided for corrosion protection, is formed on a surface of the terminal metal shell 40 by, for example, plating. The terminal metal shell 40 includes a flange 42 (terminal flange) that is disposed in a predetermined location in the axial directions, a cap mounting portion 41 that is positioned towards the rear end side than the flange 42 is, and a leg 43 (terminal leg) that is disposed towards the front end side than the flange 42 is. The cap mounting portion 41 of the terminal metal shell 40 is exposed towards the rear end side from the insulator 10. The leg 43 of the terminal metal shell 40 is inserted in the through hole 12 in the insulator 10. A plug gap to which a high-voltage cable (not shown) is connected is mounted on the cap mounting portion 41. A high voltage for generating a spark discharge is applied to the cap mounting portion 41.

A resistor 70 for reducing radio noise when a spark is generated is disposed between the front end of the terminal metal shell 40 (the front end of the leg 43) and the rear end of the center electrode 20 (the rear end of the head 23) in the through hole 12 in the insulator 10. The resistor 70 is made of, for example, a composite material of glass particles as main component, ceramic particles other than glass particles, and a conductive material. In the through hole 12, a gap between the resistor 70 and the center electrode 20 is filled with a conductive seal 60. A gap between the resistor 70 and the terminal metal shell 40 is filled with a conductive seal 80. The conductive seal 60 and the conductive seal 80 are made of a composite material of glass particles (such as $B_2O_3$—$SiO_2$-based glass particles) and metal particles (such as Cu particles and Fe particles).

Structure of Vicinity of Ground Electrode Tip 39 for Ground Electrode 30

Figure 2A:
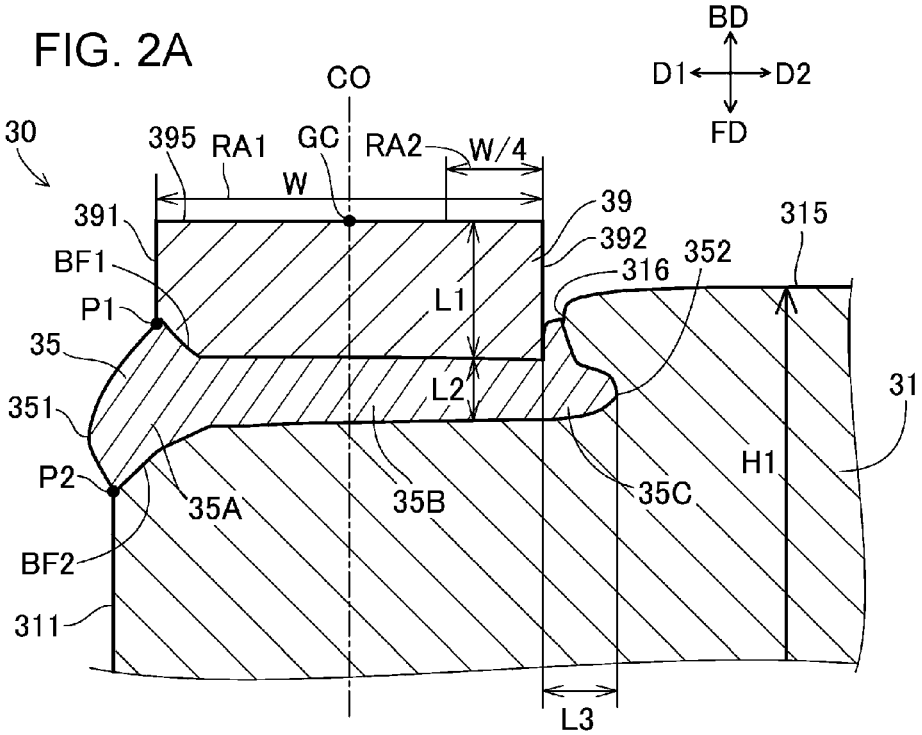
FIGS. 2A and 2B each illustrate a structure of a vicinity of a ground electrode tip for a ground electrode according to a first embodiment.
Figure 2B:
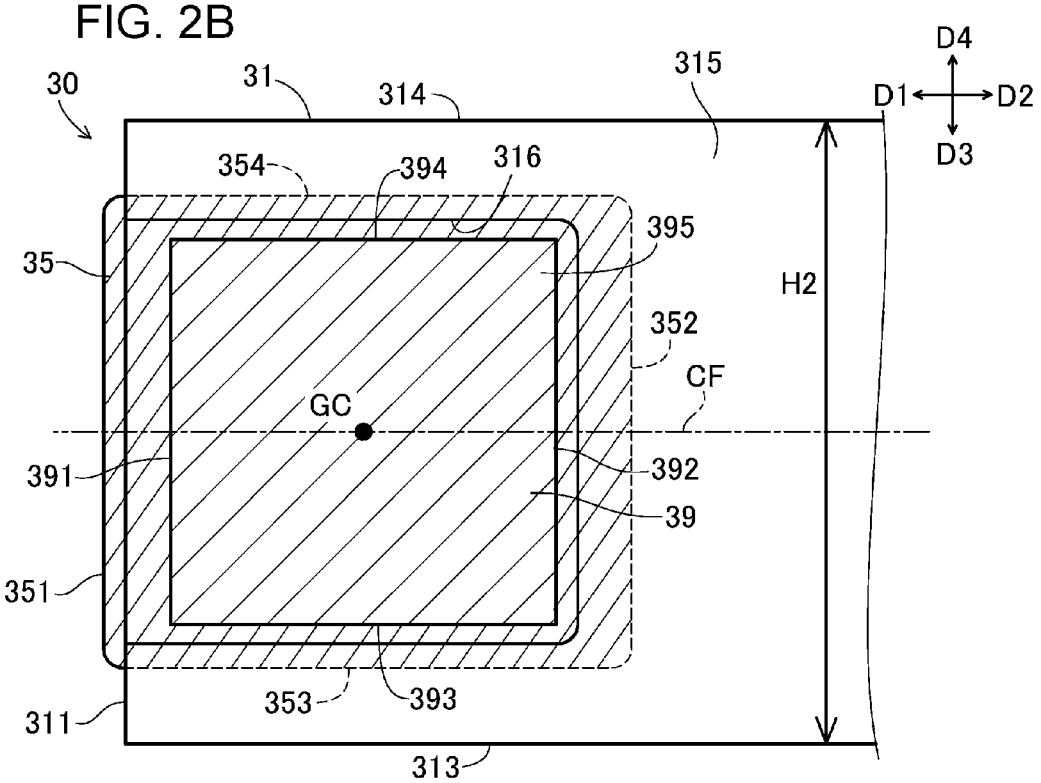

The structure of a vicinity of the ground electrode tip 39 for the ground electrode 30 is described in more detail. FIGS. 2A and 2B each illustrate the structure of the vicinity of the ground electrode tip 39 for the ground electrode 30 according to a first embodiment. FIG. 2A illustrates a section CF of a vicinity of the front end of the ignition plug 100 resulting from cutting through the vicinity by a particular plane. The ground electrode tip 39 has a substantially columnar shape. The rear end surface of the ground electrode tip 39 is a second discharge surface 395 opposing the first discharge surface 295 (see FIG. 1) of the center electrode tip 29. The section CF in FIG. 2A is a plane which extends through a center of gravity GC of the second discharge surface 395, which is perpendicular to the second discharge surface 395, and which is parallel to an axial line of the bar-shaped ground electrode body 31. In the embodiment, a line that extends through the center of gravity GC of the second discharge surface 395 and that is perpendicular to the second discharge surface 395 coincides with the axial line CO of the ignition plug 100. Therefore, it can be said that the section CF in FIG. 2A is a section that extends through the axial line CO of the ignition plug 100 and that is parallel to the axial line of the bar-shaped ground electrode body 31.

FIG. 2B illustrates a vicinity of the second discharge surface 395 of the ground electrode tip 39 when seen in the front end direction FD from the rear end direction BD. The alternate long and short dash line in FIG. 2B indicates the section CF in FIG. 2A. The direction from the center of gravity GC of the second discharge surface 395 to the free end surface 311 along the second discharge surface 395, that is, a left direction in FIGS. 2A and 2B is a first direction D1. The direction away from the free end surface 311 along the second discharge surface 395 from the center of gravity GC of the second discharge surface 395, that is, a direction opposite to the first direction D1, is a second direction D2.

Of the four side surfaces that cross the free end surface 311 of the ground electrode body 31, a side surface opposing the first discharge surface 295 is a side surface 315. Of the four side surfaces of the ground electrode body 31, two of the side surfaces that cross the side surface 315, that is, the side surfaces that are located in the up-down directions in FIG. 2B are side surfaces 313 and 314. The direction towards the side surface 313 from the center of gravity GC of the second discharge surface 395, that is, the downward direction in FIG. 2B is a third direction D3, and a direction opposite to the third direction D3 is a fourth direction D4.

In the vicinity of the free end surface 311 of the ground electrode body 31, the ground electrode tip 39 is disposed along the side surface 315. More specifically, a concave portion 316 that is recessed in the front end direction FD from the side surface 315 is formed in the vicinity of the free end surface 311 of the ground electrode body 31. A portion of the ground electrode tip 39 that is opposite to the second discharge surface 395 (a portion of the ground electrode tip 39 located towards the front end direction FD) is disposed in the concave portion 316. The second discharge surface 395 of the ground electrode tip 39 protrudes in the rear end direction BD from the side surface 315 of the ground electrode body 31. As shown in FIG. 2B, the concave portion 316 has, when seen along the axial directions, a shape that is substantially similar to (square shape in the embodiment) and slightly larger than the shape of the ground electrode tip 39 (square shape in the embodiment) when seen along the axial directions.

As illustrated in the section CF in FIG. 2A, a side surface 391 of the ground electrode tip 39 located in the first direction D1 is positioned towards the side in the second direction D2 than the free end surface 311 of the ground electrode body 31 is.

The ground electrode tip 39 is joined to the ground electrode body 31 by laser welding. Therefore, a welding portion 35, formed by the laser welding, is disposed between the ground electrode tip 39 and the ground electrode body 31. The welding portion 35 is a portion formed by melting and solidifying a portion of the ground electrode tip 39 before the welding and a portion of the ground electrode body 31. Therefore, the welding portion 35 includes the component of the ground electrode tip 39 and the component of the ground electrode body 31. The welding portion 35 may also be called a joint where the ground electrode tip 39 and the ground electrode body 31 are joined to each other, or may also be called a bead where the ground electrode tip 39 and the ground electrode body 31 are joined to each other.

In FIG. 2B, the hatched region indicates the welding portion 35. As can be seen from FIG. 2B, the welding portion 35 when seen along the axial directions has a shape that is larger than the shape of the ground electrode tip 39 (square shape in the embodiment) when seen along the axial directions, and that is substantially similar to (square shape in the embodiment) and that is slightly larger than the shape of the concave portion 316 when seen along the axial directions. Ends 351 to 354 of the welding portion 35 located in the four directions D1 to D4 are positioned outward with respect to the corresponding side surface 391 and corresponding side surfaces 392 to 394 of the ground electrode 39 in the radial directions. A side of the welding portion 35 located in the rear end direction BD contacts the entire surface of the ground electrode tip 39 opposite to the second discharge surface 395 (surface located in the front end direction FD).

As illustrated in FIG. 2A, the end 351 of the welding portion 35 located in the first direction D1 (also called the "exposed end 351") is exposed at the free end surface 311 of the ground electrode body 31. The ends 352, 353, and 354 of the welding portion 35 located in the corresponding second direction D2, third direction D3, and fourth direction D4 are not exposed at the corresponding surfaces (such as the side surfaces 313 and 314) of the ground electrode body 31. As illustrated in FIG. 2A, in the section CF, the welding portion 35 extends along the second direction D2 (the first direction D1). The axial line of the bar-shaped ground electrode body 31 is parallel to the second direction D2 (the first direction D1) in the vicinity of the free end surface 311, where the welding portion 35 is formed. Therefore, it can be said that, in the section CF, the welding portion 35 extends along the axial line of the ground electrode body 31. This is because, as described below, when the welding portion 35 is formed by laser welding, laser beams are applied in the second direction D2 from the free end surface 311.

Here, a length of the ground electrode tip 39 in directions perpendicular to the first direction D1 (axial-direction length) is a thickness L1 of the ground electrode tip 39, and a length of the welding portion 35 in the directions perpendicular to the first direction D1 is a thickness L2 of the welding portion 35. Although the thickness L1 of the ground electrode tip 39 is not limited to certain values, the thickness L1 is, for example, 0.2 mm to 1.0 mm.

As illustrated in FIG. 2A, a portion of the welding portion 35 in the vicinity of the exposed end 351 is an exposure neighboring portion 35A, a substantially center portion of the welding portion 35 that includes a portion crossing the axial line CO is a center portion 35B, and a portion of the welding portion 35 that is located in the second direction D2 from an end of the ground electrode tip 39 located in the second direction D2 (that is, the side surface 392) is a far-side portion 35C. The thickness L2 of the welding portion 35 is larger at the exposure neighboring portion 35A than at the center portion 35B. At the center portion 35B, the thickness L2 of the welding portion 35 does not change greatly, and is substantially uniform. The thickness L2 of the welding portion 35 is partly large at the far-side portion 35C because the welding portion is formed between the side surface 392 of the ground electrode tip 39 located in the second direction D2 and the concave portion 316 of the ground electrode body 31.

Here, in the section CF in FIG. 2A, an end, located in the first direction D1, of a boundary BF1 between the welding portion 35 and the ground electrode tip 39 is an end P1, and an end, located in the first direction D1, of a boundary BF2 between the welding portion 35 and the ground electrode body 31 is an end P2. Of the end P1 and the end P2, the end that is positioned towards the side in the second direction D2 is a first end. In the embodiment in FIG. 2A, the first end is the end P1. The end of the ground electrode tip 39 located in the second direction D2 (that is, the side surface 392) is a second end.

Here, a range in the first direction D1 from the first end to the second end is a range RA1 (a range having a length W in FIG. 2A). A ¼ range, provided at the second end side, of the range RA1 is a range RA2 (a range having a length W/4 in FIG. 2A). In the embodiment in FIG. 2, the length W of the range RA1 is equal to the width of the ground electrode tip 39 in the second direction D2. Although the length W is not limited thereto, the length W is, for example, from 1.0 mm to 2.0 mm, such as 1.3 mm, 1.5 mm, and 1.8 mm.

The ¼ range RA2, provided at the second end side (the side in the second direction), is, similarly to the first end side (a side in the first direction), situated in the vicinity of the front end of the ignition plug 100, so that the ¼ range RA2 is situated near a high-temperature region in the combustion chamber. Therefore, the ¼ range RA2, provided at the second end side, tends to become hot. Further, compared to the first end side, the ¼ range RA2, provided at the second end side, is close to the joining end surface 312 of the ground electrode body 31. As a result, the amount of heat conduction is large. Therefore, compared to the first end side, temperature changes are severe in the ¼ range RA2, provided at the second end side. Consequently, peeling caused by thermal stress at the boundaries BF1 and BF2 tends to occur.

As the thickness L1 of the ground electrode tip 39 increases with respect to the thickness L2 of the welding portion 35, thermal stress at the boundaries BF1 and BF2 can be reduced. This is because the thermal stress at the boundaries BF1 and BF2 occurs due to the difference between the thermal expansion coefficient of the ground electrode tip 39 and that of the ground electrode body 31, and the welding portion 35 that contains the components of both the ground electrode tip 39 and the ground electrode body 31 has a thermal expansion coefficient that is between that of the ground electrode tip 39 and that of the ground electrode body 31. In the embodiment, the entire range RA2 satisfies the condition (L2/L1)≥0.25. That is, in the entire range RA2, the thickness L2 of the welding portion 35 is greater than or equal to ¼ of the thickness L1 of the ground electrode tip 39. As a result, by making the welding portion 35 sufficiently thick, it is possible to properly reduce thermal stress, so that anti-peeling performance of the ground electrode tip 39 can be increased.

In the embodiment, further, in the range RA1 from the first end to the second end in its entirety, the aforementioned condition (L2/L1)≥0.25 is satisfied. As a result, in the range RA1 in its entirety, the thickness L2 of the welding portion 35 can be made sufficiently large with respect to the thickness L1 of the ground electrode tip 39. As a result, the welding portion 35 can further properly reduce thermal stress occurring between the ground electrode tip 39 and the ground electrode body 31, so that it is possible to further increase anti-peeling performance of the ground electrode tip 39.

Here, in the section CF in FIG. 2A, the length from the side surface 392 (the aforementioned second end) of the ground electrode tip 39 located in the second direction D2 to the end 352 of the welding portion 35 located in the second direction D2 is a far-side protruding length L3. In the embodiment, the far-side protruding length L3 is greater than or equal to 0.1 mm. This way, in the vicinity of the side surface 392 at the second-direction side of the ground electrode tip 39, the far-side portion 35C of the welding portion 35 can more effectively reduce thermal stress, so that it is possible to further increase anti-peeling performance of the ground electrode tip 39.

If the welding portion 35 is made too thick with respect to the thickness of the ground electrode tip 39, the ground electrode tip 39 becomes too thin. As a result, the strength of the ground electrode tip 39 is reduced, as a result of which thermal stress causes cracks to occur in the ground electrode tip 39, and causes the ground electrode tip 39 to break. In the embodiment, in the entire range RA2, the condition (L2/L1) ≤0.5 is satisfied. That is, in the entire range RA2, the thickness L2 of the welding portion 35 is less than or equal to half of the thickness L1 of the ground electrode tip 39. As a result, it is possible to prevent the occurrence of cracks in the ground electrode tip 39 caused by the thickness L1 of the ground electrode tip 39 being too small with respect to the thickness L2 of the welding portion 35. Therefore, it is possible to increase crack resistant performance of the ground electrode tip 39.

Further, in the embodiment, as described above, the side surface 391 of the ground electrode tip 39 located in the first direction D1 is positioned towards the side in the second direction D2 than the free end surface 311 of the ground electrode body 31 is. As a result, the joining area, that is, the area of contact with the welding portion 35 can be made sufficiently large with respect to the size of the ground electrode tip 39. Therefore, it is possible to further increase anti-peeling performance of the ground electrode tip 39.

Manufacturing Method

Figure 3A:
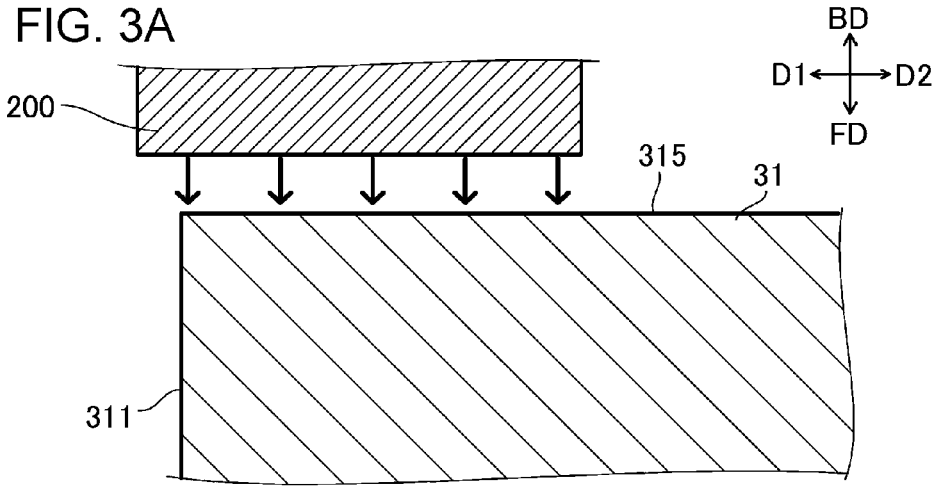
FIGS. 3A, 3B, and 3C each illustrate a method of manufacturing the ground electrode.
Figure 3B:
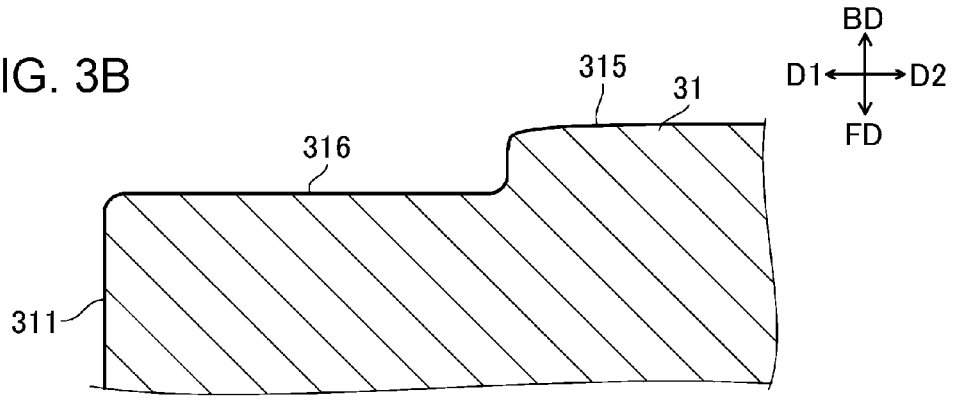

A method of manufacturing the ignition plug 100 is described while focusing on a method of manufacturing the ground electrode 30. FIGS. 3A and 3B each illustrate the method of manufacturing the ground electrode 30. First, the bar-shaped ground electrode body 31 that is not yet bent is provided. Then, the ground electrode tip 39 that is not yet welded to the ground electrode body 31 is provided.

Next, as shown in FIG. 3A, by using, for example, a predetermined pressing machine, a pressing member 200 having a shape corresponding to the shape of the concave portion 316 to be formed is pressed into a portion in the vicinity of the free end surface 311 of the side surface 315 of the ground electrode body 31. This causes the concave portion 316 to be formed in the side surface 315 of the ground electrode body 31 as shown in FIG. 3B.

Figure 3C:
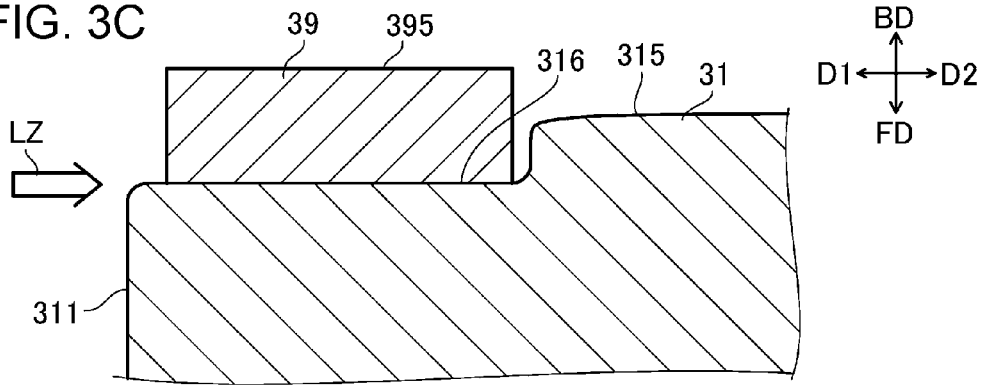

Next, as shown in FIG. 3C, the columnar ground electrode tip 39 that is not yet welded is disposed in the concave portion 316 in the ground electrode body 31. Then, while holding the ground electrode 30 in the front end direction FD (downward direction in FIG. 3C) from the side of the second discharge surface 395 by using a jig (not shown), laser welding is performed to form the above-described welding portion 35 (see FIGS. 2A and 2B). An arrow LZ in FIG. 3C conceptually indicates application of laser for performing the laser welding. As shown by the arrow LZ, a laser beam is applied in the second direction D2 from the side of the free end surface 311 and along the boundary between the ground electrode tip 39 and the ground electrode body 31. In the embodiment, a fiber laser is used as the laser. Compared to, for example, a YAG laser, the fiber laser has high light-condensing ability. Therefore, the welding portion 35 that can be formed has high shape flexibility. Consequently, it is possible to form the welding portion 35 having a shape that satisfies the above-described conditions such as the condition (L2/L1)≥0.25.

First Evaluation Test:

In a first evaluation test, as shown in Table 1, fourteen Samples 1 to 14 in which at least one of the lengths W, L1, L2, and L3 in FIG. 2A differed were used to conduct anti-peeling performance tests of the ground electrode tip 39.

TABLE 1

| No. | W | L1 | L2 | L2/L1 | L3 | Oxide Scale Occurrence Rate [%] | Evaluation Result |
|---|---|---|---|---|---|---|---|
| 1 | 1.3 | 0.43 | 0.05 | 0.12 | 0.2 | 35 | C |
| 2 | 1.3 | 0.4 | 0.08 | 0.20 | 0.0 | 30 | C |
| 3 | 1.3 | 0.4 | 0.1 | 0.25 | 0.2 | 5 | A |
| 4 | 1.3 | 0.4 | 0.1 | 0.25 | 0.1 | 6 | A |
| 5 | 1.3 | 0.4 | 0.1 | 0.25 | 0.0 | 15 | B |
| 6 | 1.3 | 0.35 | 0.15 | 0.43 | 0.2 | 2 | A |
| 7 | 1.3 | 0.35 | 0.15 | 0.43 | 0.1 | 3 | A |
| 8 | 1.8 | 0.42 | 0.04 | 0.10 | 0.2 | 40 | C |
| 9 | 1.8 | 0.4 | 0.09 | 0.23 | 0.0 | 33 | C |
| 10 | 1.8 | 0.39 | 0.1 | 0.26 | 0.2 | 7 | A |
| 11 | 1.8 | 0.39 | 0.1 | 0.26 | 0.1 | 9 | A |
| 12 | 1.8 | 0.39 | 0.1 | 0.26 | 0.0 | 20 | B |
| 13 | 1.8 | 0.37 | 0.14 | 0.38 | 0.2 | 4 | A |
| 14 | 1.8 | 0.37 | 0.14 | 0.38 | 0.1 | 6 | A |

The lengths W in the sections CF (FIG. 2A) are equal to the widths of the ground electrode tips 39 in the second direction D2. Therefore, by varying the widths of the ground electrode tips 39 in the second direction D2, the lengths W in the sections CF were adjusted to either one of 1.3 mm and 1.8 mm as shown in Table 1. The widths of the ground-electrode-tip-39 samples in the third direction D3 were the same as the widths of the ground-electrode tip-39 samples in the second direction D2 (1.3 mm or 1.8 mm).

The lengths L1 to L3 in the section CF (FIG. 2A) were adjusted by varying the lengths of the ground electrode tips 39 before welding in the axial directions and the conditions of laser welding for forming the welding portions 35. Table 1 shows, for each sample, the values of L1 (*mm*) and L2 (*mm*), at a location in the first direction D1 where the value (L2/L1) becomes a minimum, and the value of (L2/L1) in the range RA2 in FIG. 2A. When the minimum value of (L2/L1) in the range RA2 satisfies the condition (L2/L1) ≥0.25, the condition (L2/L1) 0.25 is satisfied over the entire range RA2.

The minimum value of (L2/L1) in the range RA2 for each of the Samples 1 to 14 is any one of 0.10, 0.12, 0.20, 0.23, 0.25, 0.26, 0.38, and 0.43.

The far-side protruding length L3 of each of the Samples 1 to 14 is any one of 0.0 mm, 0.1 mm, and 0.2 mm.

The common materials and dimensions of the samples are as follows:

Ground electrode tip 39: alloy containing platinum (Pt) as main component and 10 mass % of nickel (Ni)

Ground electrode body 31: NCF601 alloy

Width H1 (height) of the ground electrode body 31 in the axial directions in the vicinity of the free end surface 311: 1.5 mm Width H2 of the ground electrode body 31 in the third direction D3 in the vicinity of the free end surface 311: 2.8 mm Width (height) of the ground electrode tip 39 before welding in the axial directions: 0.45 mm In the first evaluation test, a desk cooling test described below was performed. A cycle of heating and cooling the vicinity of the front end portion of each sample (the vicinity of each ground electrode tip 39) was repeated 1000 times. More specifically, in one cycle, the vicinity of the front end portion of each sample was heated for two minutes by using a burner, and was subsequently cooled in air for one minute. The intensity of the burner was adjusted such that, during the two minutes of heating, the temperature of each ground electrode tip 39 reached a temperature of 1100° C. (target temperature) in one minute, and, then, this temperature of 1100° C. was maintained.

Thereafter, each ground-electrode-30 sample was cut to observe the section CF (FIG. 2A) of each sample. Then, in each section CF, portions where the joints at the boundaries BF1 and BF2 were maintained and any peeled portion at the boundaries BF1 and BF2 in the range RA2 were identified. At the portions where the joints were maintained, oxide scales did not occur, whereas, at the any peeled portion, oxide scales occurred. Therefore, it is possible to identify the portions where the joints are maintained and the any peeled portion by observing the section CF of each sample by using a magnifying glass. The proportion of the range RA2 occupied by the any peeled portion from the end at the side in the second direction D2 (that is, the portion where oxide scales occurred) was calculated. (This proportion may hereunder also be called the "oxide scale occurrence rate".) The oxide scale occurrence rate of each sample is as shown in Table 1. When the oxide scale occurrence rate was less than 10%, the sample evaluation result was "A"; when the oxide scale occurrence rate was 10% to less than 25%, the sample evaluation result was "B"; and when the oxide scale occurrence rate was greater than or equal to 25%, the sample evaluation result was "C".

The evaluation results are as shown in Table 1. The evaluation results of the Samples 3 to 7 and Samples 10 to 14 satisfying the condition (L2/L1)≥0.25 in the entire range RA2 were "B" or better regardless of the length W (the width of the corresponding ground electrode tip 39 in the second direction D2) and the far-side protruding length L3. The evaluation results of the Samples 1, 2, 8, and 9, where the minimum value of (L2/L1) in the range RA2 was (L2/L1)<0.25, were "C" or worse. For example, the oxide scale occurrence rates of the samples satisfying the condition (L2/L1)≥0.25 in the entire range RA2 was smaller by at least 10% than the oxide scale occurrence rates of the samples whose minimum value of (L2/L1) in the entire range RA2 was (L2/L1)<0.25.

Further, among the evaluation results of the Samples 3 to 7 and 10 to 14 satisfying the condition (L2/L1)≥0.25 in the entire range RA2, the evaluation results of the Samples 3, 4, 6, 7, 10, 11, 13, and 14, whose far-side protruding lengths L3 were greater than or equal to 0.1 mm, were all "A". The evaluation results of the Samples 5 and 12, whose far-side protruding lengths L3 were less than 0.1 mm, were both "B". For example, the scale occurrence rates of the Samples 3, 4, 6, 7, 10, 11, 13, and 14, whose far-side protruding lengths L3 were greater than or equal to 0.1 mm, were smaller by at least 9% than the scale occurrence rates of the Samples 5 and 12, whose far-side protruding lengths L3 were less than 0.1 mm.

On the basis of the results of the first evaluation test, it was confirmed that it is desirable to satisfy the condition (L2/L1)≥0.25 in the entire range RA2 from the viewpoint of increasing anti-peeling performance. In addition, it was confirmed that it is more desirable that the far-side protruding length L3 be greater than or equal to 0.1 mm.

Second Evaluation Test:

In a second evaluation test, as shown in Table 2, six Samples 15 to 20 in which at least one of the length W, L1, and L2 in FIG. 2A differed were used to conduct crack resistant performance tests of ground electrode tips 39.

TABLE 2

| No. Result | W | L1 | L2 | L2/L1 | L3 | Evaluation Result |
|---|---|---|---|---|---|---|
| 15 | 1.3 | 0.3 | 0.15 | 0.50 | 0.2 | A |
| 16 | 1.3 | 0.3 | 0.2 | 0.67 | 0.2 | B |
| 17 | 1.3 | 0.25 | 0.2 | 0.80 | 0.2 | B |
| 18 | 1.8 | 0.35 | 0.15 | 0.43 | 0.2 | A |
| 19 | 1.8 | 0.32 | 0.18 | 0.56 | 0.2 | B |
| 20 | 1.8 | 0.28 | 0.2 | 0.71 | 0.2 | B |

As in the first evaluation test, by varying the widths of the ground electrode tips 39 in the second direction D2, the widths W in the sections CF (FIG. 2A) were adjusted to either one of 1.3 mm and 1.8 mm as shown in Table 2.

The lengths L1 to L3 in the sections CF (FIG. 2A) were adjusted by varying the lengths of the ground electrode tips 39 before welding in the axial directions and by using different conditions for laser welding for forming welding portions 35. Table 2 shows, for each sample, the values of L1 (*mm*) and L2 (*mm*), at a location in the first direction where the value (L2/L1) becomes a maximum, and the value of (L2/L1) in the range RA2. When the maximum value of (L2/L1) in the range RA2 satisfies the condition (L2/L1) 0.5, the condition (L2/L1)≤0.5 is satisfied over the entire range RA2.

The maximum value of (L2/L1) in the range RA2 for each of the Samples 15 to 20 is any one of 0.50, 0.67, 0.80, 0.43, 0.56, and 0.71. The far-side protruding length L3 of each of the Samples 15 to 20 is 0.2 mm. The material of each sample is the same as the material of each sample in the first evaluation test.

In the second evaluation test, a desk cooling test was performed under the same conditions as those in the first evaluation test. Thereafter, each ground-electrode-tip-39 sample was observed to confirm the occurrence and non-occurrence of cracks. Evaluation results of samples in which cracks were not observed were "A", and evaluation results of samples in which cracks were observed were "B".

The evaluation results are as shown in Table 2. The evaluation results of the Samples 15 and 18 satisfying the condition (L2/L1)≤0.5 in the entire range RA2 were "A" regardless of the length W (the width of each ground electrode tip 39). The evaluation results of the Samples 16, 17, 19 and 20, where the maximum value of (L2/L1) in the range RA2 was (L2/L1)>0.5, were "B".

On the basis of the results of the second evaluation test, it was confirmed that it is desirable to satisfy the condition (L2/L1)≤0.5 in the entire range RA2 from the viewpoint of increasing crack resistant performance of the ground electrode tip 39.

B. Second Embodiment

Figure 4:
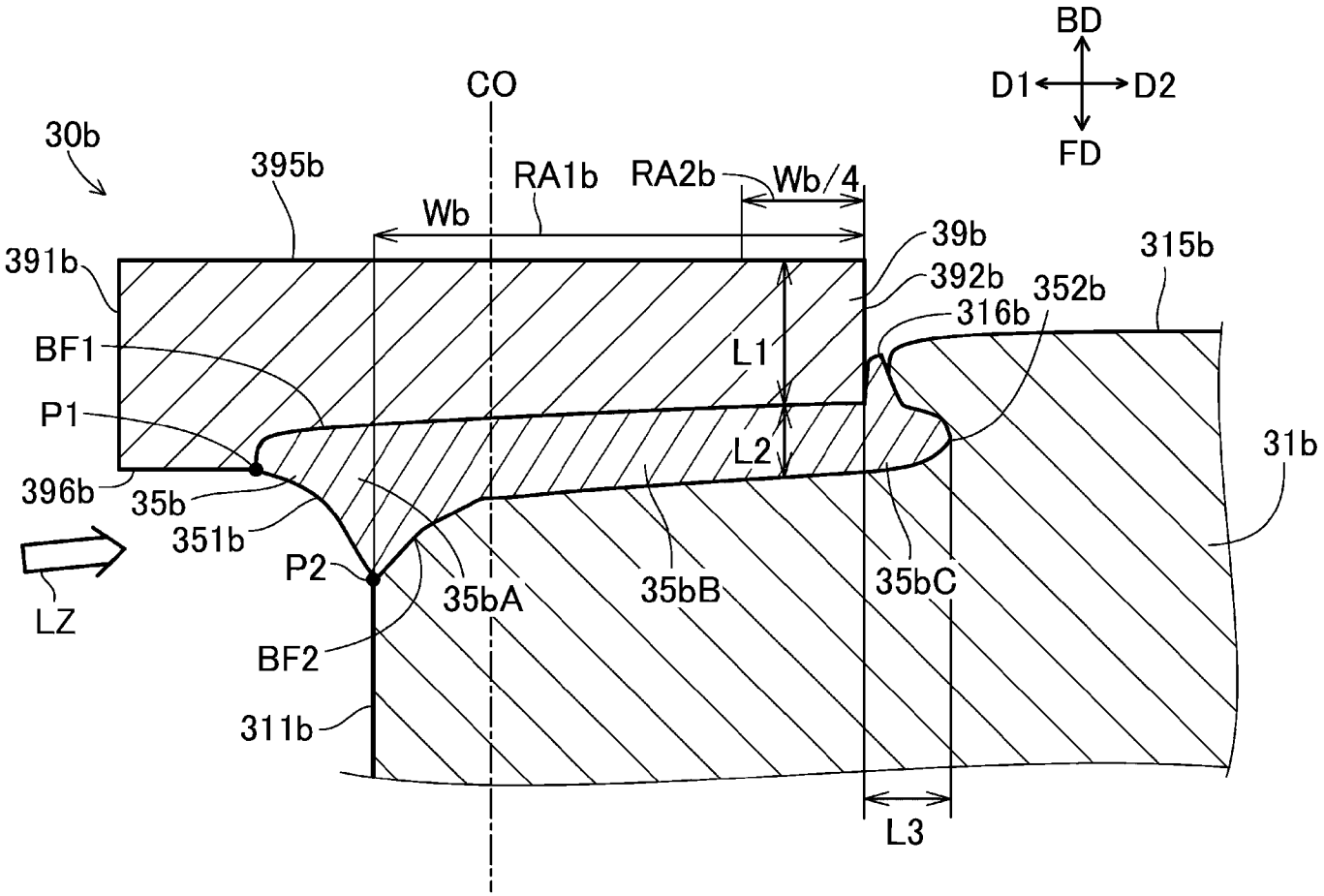
FIG. 4 illustrates a structure of a vicinity of a ground electrode tip for a ground electrode according to a second embodiment.

FIG. 4 illustrates a structure of a vicinity of a ground electrode tip 39*b* of a ground electrode 30*b* according to a second embodiment. The width of the ground electrode tip 39*b* in FIG. 4 in the second direction D2 is greater than that of the ground electrode tip 39 in FIG. 2. In addition, a side surface 391*b* of the ground electrode tip 39*b* located in the first direction D1 protrudes towards the side in the first direction D1 with respect to a free end surface 311*b* of a ground electrode body 31*b*. Therefore, the shape of a welding portion 35*b* of the ground electrode 30*b* in FIG. 4 differs from the shape of the welding portion 35 of the ground electrode 30 in FIGS. 2A and 2B.

More specifically, the welding portion 35*b* does not contact a portion 396*b*, disposed at the side in the first direction D1, of a surface of the ground electrode tip 39*b* at the side in the front end direction FD. An end 351*b* of the welding portion 35*b* located in the first direction D1 is exposed at the free end surface 311*b* of the ground electrode body 31*b* and at the portion 396*b*, disposed at the side in the first direction D1, of the surface of the ground electrode tip 39*b* at the side in the front end direction FD.

The other features of the welding portion 35*b* are similar to those of the welding portion 35 in FIGS. 2A and 2B. For example, an end 352*b* of the welding portion 35*b* located in the second direction D2 protrudes towards the second direction D2 with respect to the side surface 391*b* of the ground electrode tip 39*b*. A thickness L2 of the welding portion 35*b* is larger at an exposed vicinity 35*b* A than at a center portion 35*b* B. The thickness L2 of the welding portion 35*b* is substantially uniform without changing greatly at the center portion 35*b* B. The thickness L2 of the welding portion 35 is partly large at a far-side portion 35*b* C.

As shown in FIG. 4, such welding portion 35*b* is formed by applying a laser beam LZ, used for laser welding, to a boundary between the ground electrode tip 39*b* and the ground electrode body 31*b* from the side of the free end surface 311*b* in a direction that is slightly inclined with respect to the second direction D2.

Here, as in the first embodiment, in a section CF in FIG. 4, an end, located in the first direction D1, of a boundary BF1 between the welding portion 35*b* and the ground electrode tip 39*b* is an end P1, and an end, located in the first direction D1, of a boundary BF2 between the welding portion 35*b* and the ground electrode body 31*b* is an end P2. Of the end P1 and the end P2, the end that is positioned towards the side in the second direction D2 is a first end; and a side surface 392*b* of the ground electrode tip 39*b* located in the second direction D2 is a second end. In the second embodiment in FIG. 4, unlike the first embodiment in FIGS. 2A and 2B, since the end P2 is positioned towards the side in the second direction D2 than the end P1 is, the first end is the end P2.

Here, a range in the first direction D1 from the first end to the second end is a range RA1*b* (a range having a length Wb in FIG. 4). A ¼ range, provided at the second end side, of the range RA1*b* is a range RA2*b* (a range having a length Wb/4 in FIG. 4).

In the second embodiment, as in the first embodiment, in the section in FIG. 4, the following Conditions (A) to (D) are satisfied:

(A) In the entire range RA2*b*, (L2/L1)≥0.25 is satisfied.

(B) In the range RAlb in its entirety, (L2/L1)≥0.25 is satisfied.

(C) A far-side protruding length L3 is greater than or equal to 0.1 mm.

(D) The entire range RA2*b* satisfies (L2/L1)<0.5.

Since the aforementioned Conditions (A) to (C) are satisfied, even in the second embodiment, as in the first embodiment, it is possible to increase anti-peeling performance of the ground electrode tip 39*b*. In addition, since the Condition (D) is satisfied, even in the second embodiment, as in the first embodiment, it is possible to increase crack resistant performance of the ground electrode tip 39*b*.

Modifications (1) In the first embodiment, in the section CF in FIG. 2A, the following Conditions (A) to (D) are satisfied as already mentioned above:

(A) In the entire range RA2, (L2/L1)≥0.25 is satisfied.

(B) In the range RA1 in its entirety, (L2/L1)≥0.25 is satisfied.

(C) The far-side protruding length L3 is greater than or equal to 0.1 mm.

(D) In the entire range RA2, (L2/L1)<0.5 is satisfied.

In a modification, not all of the aforementioned Conditions (A) to (D) need to be satisfied. Only at least the aforementioned Condition (A) needs to be satisfied, so that none of the aforementioned Conditions (B) to (D) need to be satisfied, or some of the aforementioned Conditions (B) to (D) need not be satisfied. As can be understood from the results of the first evaluation test, as long as at least the Condition (A) is satisfied, it is possible to increase anti-peeling performance of the ground electrode tip 39.

(2) In the first embodiment, the aforementioned Conditions (A) to (D) are satisfied not only in the section CF in FIG. 2A, but also in all sections that are parallel to the section CF and that are within a range that extends through the second discharge surface 395 of the ground electrode tip 39. In a modification, the aforementioned Conditions (A) to (D) need not be satisfied in all of the sections that extend through the discharge surface 395, so that the aforementioned Conditions (A) to (D) only need to be satisfied in at least the section CF. In addition, of all of the sections that are parallel to the section CF and that are within the range that extends through the second discharge surface 395 of the ground electrode tip 39, it is desirable that the Conditions (A) to (D) be satisfied in a range that is 50% or greater from the section CF as a center; and it is further desirable that the Conditions (A) to (D) be satisfied in a range that is 80% or greater from the section CF as a center.

Figure 5:
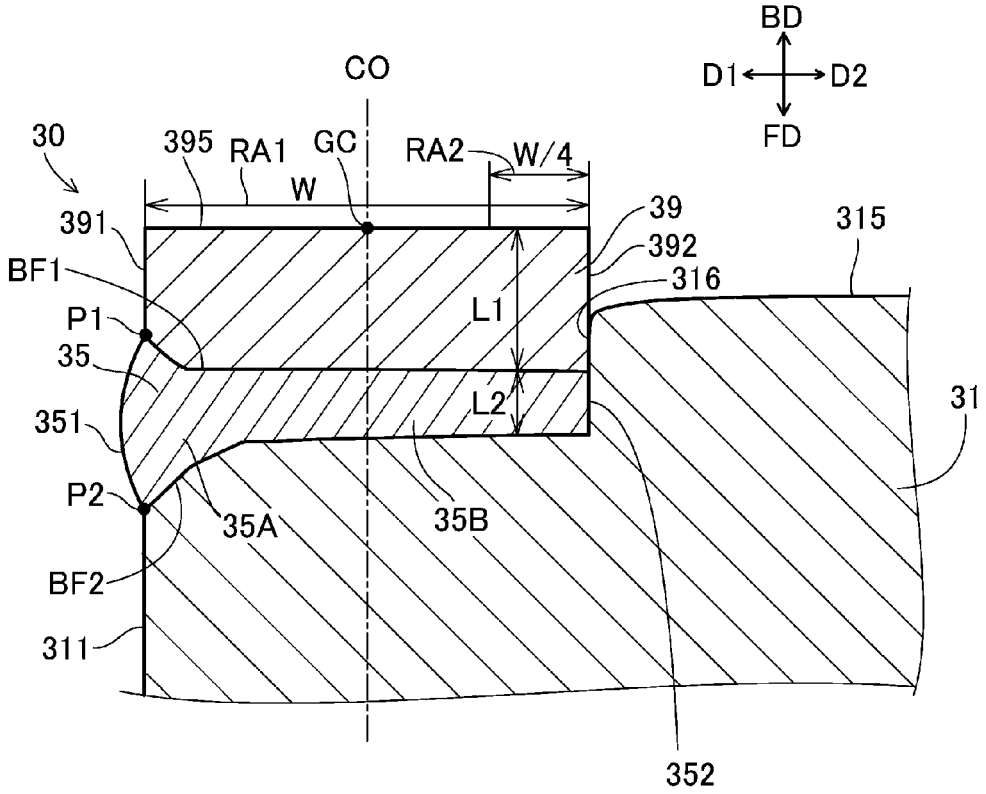
FIG. 5 illustrates an exemplary modification of the ground electrode.

(3) The specific structure of the ground electrode 30 in FIGS. 2A and 2B and the specific structure of the ground electrode 30*b* in FIG. 4 are examples, so that other specific structures are possible. The specific structure of the ground electrode 30 in FIGS. 2A and 2B and the specific structure of the ground electrode 30*b* in FIG. 4 may be modified as appropriate. FIG. 5 illustrates an exemplary modification of the ground electrode 30.

As shown in FIG. 5, for example, unlike the first embodiment, a gap need not be formed between the side surface 392 of the ground electrode tip 39 located in the second direction D2 and an inside wall defining the concave portion 316. In addition, as shown in FIG. 5, the position in the second direction D2 of the end 352 of the welding portion 35 located in the second direction may be aligned with the position in the second direction D2 of the side surface 392 of the ground electrode tip 39 located in the second direction D2. That is, the welding portion 35 need not include the far-side portion 35C. As shown in FIG. 5, the position in the first direction D1 of the side surface 391 of the ground electrode tip 39 located in the first direction D1 may be aligned with the position in the first direction D1 of the free end surface 311 of the ground electrode body 31.

(4) Although in the first and second embodiments, the ground electrode tips 39 and 39*b* each have a substantially quadrangular prism shape, the ground electrode tips 39 and 39*b* may each have other shapes, such as a columnar shape and pentagonal prism shape.

(5) In the first and second embodiments, the ground electrode tips 39 and 39*b* are welded to the respective concave portions 316 and 316*b* after forming the concave portions 316 and 316*b* in the respective side surfaces 315 and 315*b* in the vicinity of the free end surfaces 311 and 311*b* of the respective ground electrode bodies 31 and 31*b*. However, instead, the ground electrode tips 39 and 39*b* may be welded to the respective side surfaces 315 and 315*b* without forming the concave portions 316 and 316*b* in the respective side surfaces 315 and 315*b* in the vicinity of the respective free end surfaces 311 and 311*b*.

(6) In the ignition plug 100, the materials and the dimensions of the ground electrode 30, the metal shell 50, the center electrode 20, the insulator 10, etc., may be variously changed. For example, the metal shell 50 may be made of low-carbon steel plated with zinc or nickel, or may be made of low-carbon steel that is not plated. The insulator 10 may be made of various types of insulating ceramics in addition to alumina.

Although the present invention is described on the basis of the embodiments and modifications, the embodiments according to the present invention described above are described for the sake of facilitating the understanding of the present invention, and do not limit the present invention. The present invention may be changed and modified without departing from the gist thereof and scope of the claims, and includes equivalents of the present invention.

What is claimed is:

1. An ignition plug comprising:

an insulator that includes a through hole;

a center electrode that includes a first discharge surface and that is held at a front end side of the through hole;

a metal shell that is disposed around the insulator in a radial direction and that holds the insulator;

a bar-shaped ground electrode body that includes a joining end surface and a free end surface, the joining end surface being joined to a front end of the metal shell, the free end surface being positioned opposite to the joining end surface;

a ground electrode tip that is disposed along a side surface of the ground electrode body opposing the first discharge surface near the free end surface of the ground electrode body, and that includes a second discharge surface opposing the first discharge surface; and a welding portion that is disposed between the ground electrode tip and the ground electrode body, and that includes a component of the ground electrode tip and a component of the ground electrode body, wherein, in a section which extends through a center of gravity of the second discharge surface, which is perpendicular to the second discharge surface, and which is parallel to an axial line of the ground electrode body, a direction from the center of gravity of the second discharge surface to the free end surface along the second discharge surface is a first direction, and a direction opposite to the first direction is a second direction, of an end, located in the first direction, of a boundary between the welding portion and the ground electrode tip and an end, located in the first direction, of a boundary between the welding portion and the ground electrode body, the end that is positioned towards a side in the second direction is a first end, and an end of the ground electrode tip located in the second direction is a second end;

wherein an end of the welding portion located in the first direction is exposed at the free end surface, the welding portion extends along the axial line of the ground electrode body, and wherein, over an entire sub-range of a range, the range extending from the first end to the second end, the sub-range being ¼ of the range nearest the second end, a length L1 of the ground electrode tip in a direction perpendicular to the first direction and a length L2 of the welding portion in the direction perpendicular to the first direction satisfy (L2/L1)≥0.25.

2. The ignition plug according to claim 1, wherein, in the section, further, over an entirety of the range, the length L1 of the ground electrode tip in the direction perpendicular to the first direction and the length L2 of the welding portion in the direction perpendicular to the first direction satisfy (L2/L1)≥0.25.

3. The ignition plug according to claim 1, wherein, in the section, further, a length L3 from the second end to an end of the welding portion located in the second direction is greater than or equal to 0.1 mm.

4. The ignition plug according to claim 1, wherein, in the section, further, in the entire sub-range, the length L1 of the ground electrode tip in the direction perpendicular to the first direction and the length L2 of the welding portion in the direction perpendicular to the first direction satisfy (L2/L1) ≤0.5.

5. The ignition plug according to claim 1, wherein an end of the ground electrode tip located in the first direction is positioned more in the second direction than the free end surface of the ground electrode body.

* * * * *